US007877028B2

(12) United States Patent
Shida

(10) Patent No.: US 7,877,028 B2
(45) Date of Patent: Jan. 25, 2011

(54) APPARATUS AND A METHOD FOR FORMING AN IMAGE ON A SHEET

(75) Inventor: Koji Shida, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 91 days.

(21) Appl. No.: 12/332,050

(22) Filed: Dec. 10, 2008

(65) Prior Publication Data

US 2009/0148176 A1 Jun. 11, 2009

Related U.S. Application Data

(60) Provisional application No. 61/012,774, filed on Dec. 10, 2007.

(51) Int. Cl.
*G03G 15/00* (2006.01)

(52) U.S. Cl. ..... 399/45; 399/122

(58) Field of Classification Search ..... 399/38, 399/45, 67–69, 107, 121, 122
See application file for complete search history.

(56) References Cited

U.S. PATENT DOCUMENTS

| | | | | |
|---|---|---|---|---|
| 6,070,023 | A * | 5/2000 | Kataoka | 399/45 |
| 6,381,423 | B1 * | 4/2002 | Eom | 399/45 |
| 6,898,382 | B2 * | 5/2005 | Shibaki | 399/16 |
| 2007/0071467 | A1 * | 3/2007 | Mitsuya et al. | 399/45 |

FOREIGN PATENT DOCUMENTS

| | | |
|---|---|---|
| JP | PH03-020877 | 1/1991 |
| JP | PH10-153927 | 6/1998 |
| JP | 2003-285484 | 10/2003 |
| JP | P2005-037871 | 2/2005 |

* cited by examiner

*Primary Examiner*—Hoan Tran
(74) *Attorney, Agent, or Firm*—Patterson & Sheridan, LLP

(57) ABSTRACT

In the image forming apparatus according to the invention, a fixer fixes toner on the sheet and presses the sheet, and a media sensor measures a thickness of the sheet before pressurization and a thickness of the sheet after pressurization. Then, by calculating an amount of heat used if the fixer fixes the toner on the sheet on the basis of the measurement result, a control unit is able to control the temperature of the fixer on the basis of the calculated amount of heat. In this manner, it is possible to appropriately calculate an amount of heat per unit area required to fix toner on the sheet.

20 Claims, 8 Drawing Sheets

APPARATUS AND A METHOD FOR FORMING AN IMAGE ON A SHEET

CROSS-REFERENCE TO RELATED APPLICATIONS

This application is based upon and claims the benefit of priority from: U.S. Provisional Application No. 61/012,774, filed on Dec. 10, 2007, the entire contents of which is incorporated herein by reference.

TECHNICAL FIELD

The present invention relates to an image forming apparatus and an image forming method, particularly, to an image forming apparatus capable of calculating an amount of heat per unit area required to fix toner on a sheet and an image forming method therefor.

BACKGROUND

In electrophotographic techniques used in MFP (Multi Function Peripheral), a fixing unit heats and presses unfixed toner to fix the unfixed toner on a sheet. In order that the fixing unit appropriately fixes toner on a sheet, it is necessary to apply an appropriate amount of heat per unit area of the sheet. A correlation between mass of the sheet and the amount of heat per unit area required to appropriately fix the toner on the sheet exists. Specially, the mass of the sheet is obtained by multiplying a density of the sheet by a volume thereof. Accordingly, generally, in order that the fixing unit appropriately fixes the toner on the sheet, an amount of heat per unit area required to appropriately fix the toner on the sheet is calculated on the basis of the correlation mentioned above.

The known method of calculating the amount of heat per unit area required to appropriately fix the toner on the sheet is as follows. Japanese Unexamined Patent Application Publication No. 2003-285484 discloses a technique capable of detecting a thickness of a recording sheet conveyed into the image forming apparatus, and controlling a fixing temperature.

However, in the technique disclosed in Japanese Unexamined Patent Application Publication No. 2003-285484, a density of the sheet is indirectly estimated by measuring the paper thickness of the sheet, and the density of the sheet itself is not measured. Thus, the technique does not focus on the density of the sheet itself. Hence, when a sheet has a thickness larger than a thickness of a normal sheet and has a density lower than a density of the normal sheet, the calculated amount of heat per unit area required to appropriately fix the toner on the sheet becomes larger than an amount of heat required in real situation. In contrast, when a sheet has a thickness larger than thickness of a normal sheet and has a density higher than density of the normal sheet, the calculated amount of heat per unit area required to appropriately fix the toner on the sheet becomes smaller than an amount of heat required in real situation. As just described, since the density of the sheet itself is not measured, a problem arises that it is difficult to appropriately calculate an amount of heat per unit area required to fix the toner on the sheet.

SUMMARY

The invention has been made in consideration of this situation mentioned above, and it is desired to provide an image forming apparatus capable of suitably calculating an amount of heat per unit area required to fix toner on a sheet and an image forming method therefor.

According to an aspect of the invention, in order to solve the problem mentioned above, an image forming apparatus includes: a fixing unit configured to fix toner on a sheet; a pressing unit configured to press the sheet; a measuring unit configured to measure a thickness of the sheet before the sheet is pressed by the pressing unit, and measuring a thickness of the sheet after the sheet is pressed by the pressing unit; a calculating unit configured to calculate an amount of heat used if the fixing unit fixes the toner on the sheet, on the basis of a measurement result obtained by the measuring unit; and a control unit configured to control the fixing unit on the basis of the amount of heat calculated by the calculating unit.

According to another aspect of the invention, in order to solve the problem mentioned above, an image forming apparatus includes: a fixing unit configured to fix toner on a sheet, the fixing unit including a pressing roller and a heating roller opposed to each other; a measuring unit configured to measure a thickness of the sheet before the sheet is pressed by the fixing unit, and measuring a thickness of the sheet after the sheet is pressed by the fixing unit; a calculating unit configured to calculate an amount of heat used if the fixing unit fixes the toner on the sheet, on the basis of a measurement result obtained by the measuring unit; and a control unit configured to control the fixing unit on the basis of the amount of heat calculated by the calculating unit.

According to a further aspect of the invention, in order to solve the problem mentioned above, there is provided an image forming method of an image forming apparatus provided with a fixer including a pressing roller and a heating roller. The method includes: fixing toner on a sheet; pressing the sheet; measuring a thickness of the sheet before pressurization; measuring a thickness of the sheet after pressurization; calculating an amount of heat required to fix the toner on the sheet, on the basis of a measurement result; and controlling the fixer on the basis of the calculated amount of heat.

DETAILED DESCRIPTION

Hereinafter, the embodiment will be described with reference to the attached drawings.

Figure 1:
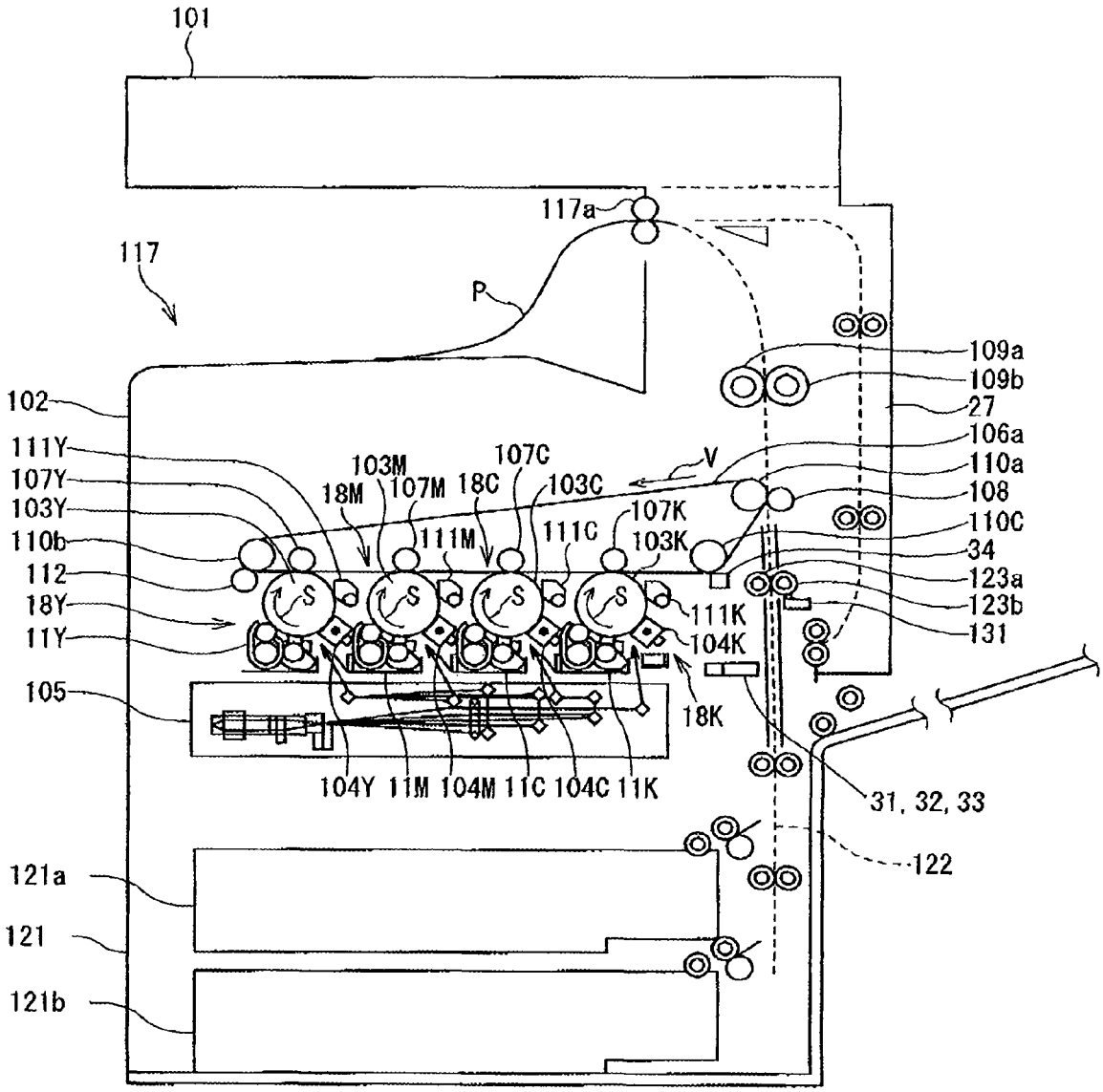
FIG. 1 is a diagram illustrating a configuration of an image forming apparatus according to an embodiment of the invention.

FIG. 1 shows a configuration of the image forming apparatus 1 according to the embodiment. As shown in FIG. 1, the image forming apparatus 1 includes a scanner unit 101 serving as an image scanning device and a printer drive unit 102 serving as an image forming unit. The scanner unit 101 scans an original document placed on an original-document platen glass. Further, the image forming apparatus 1 includes a sheet feeding unit 121 for feeding a sheet P to the printer drive unit 102. The sheet feeding unit 121 extracts the sheet P from a sheet feeding cassette 121*a* or a sheet feeding cassette 121*b*, and supplies the sheet P to a registration roller 123 along a conveying path 122. The registration roller 123 includes a stationary roller 123*a* and a movable roller. 123*b*.

The printer drive unit 102 has four image forming units 18 using electrophotography based on reverse development in four-series tandem. The image forming units 18 are formed as four groups such as yellow (Y), magenta (M), cyan (C), and black (K), and are arranged in parallel along the lower part of an intermediate transfer belt 106*a*. Configurations of the image forming units 18Y, 18M, 18C, and 18K are the same. Around photoconductive drums 103Y, 103M, 103C, and 103K of the image forming units 18Y, 18M, 18C, and 18K, there are arranged in a rotation direction of the arrow S, electrifying units 104Y, 104M, 104C, and 104K, developing units 11Y, 11M, 11C, and 11K, photoconductor cleaners 111Y, 111M, 111C, and 111K, and electricity removers 113Y, 113M, 113C, and 113K, respectively.

A laser optical system unit 105 irradiates laser beams respectively on the gaps between the developing units 11Y, 11M, 11C, and 11K and the electrifying units 104Y, 104M, 104C, and 104K arranged around the photoconductive drums 103Y, 10.3M, 103C, and 103K. The image forming units 18Y, 18M, 18C, and 18K form toner images on the photoconductive drums 103Y, 103M, 103C, and 103K.

Drum thermistors 30Y, 30M, 30C, and 30K come into contact with non-image forming area of the photoconductive drums 103Y, 103M, 103C, and 103K, and detect temperatures of surfaces of the photoconductive drums 103Y, 103M, 103C, and 103K. The photoconductive drums 103Y, 103M, 103C, and 103K are integrally supported with the electrifying units 104Y, 104M, 104C, and 104K by a unit frame, and thereby a process unit can be formed.

To the intermediate transfer belt 106*a*, a required tensile force is applied by a drive roller 110*a*, a driven roller 110*b*, and a tension roller 110*c*. A belt cleaner 112 is disposed in the vicinity of the driven roller 110*b*. Primary transfer rollers 107Y, 107M, 107C, and 107K are disposed on primary transfer positions opposed to the photoconductive drums 103Y, 103M, 103C, and 103K with the intermediate transfer belt 106*a* interposed therebetween. A secondary transfer roller 108 is disposed on a secondary transfer position opposed to the drive roller 110*a* with the intermediate transfer belt 106*a* interposed therebetween. To the secondary transfer position, the sheet P is supplied from the sheet feeding cassette 121*a* or 121*b* through the conveying path 122. The secondary transfer roller 108 secondary-transfers a color toner image formed by superposing toner images having a plurality of colors on the intermediate transfer belt 106*a* to the sheet P. A density sensor 34 is provided in the vicinity of the intermediate transfer belt 106*a* before reaching the drive roller 110*a*. The density sensor 34 detects a density of the toner image formed on the intermediate transfer belt 106*a*.

The printer drive unit 102 has a fixer 109 for fixing a color toner image on the sheet P that is transferred by the secondary transfer roller 108 and a sheet discharging roller 117*a* for discharging the sheet P having the toner image fixed thereon to a sheet discharging unit 117. The fixer 109 includes a pressing roller 109*a* and a heating roller 109*b*. The printer drive unit 102 has a reverse conveying mechanism 27 for reversing and conveying the sheet P at the time of image formation based on duplex printing. Further, the printer drive unit 102 has a temperature sensor 31, an air-pressure sensor 32, and a relative humidity sensor 33.

In the image forming apparatus 1, the scanner unit 101 reads an original document at the time of starting an operation of the image forming process. The printer drive unit 102 drives the image forming units 18Y, 18M, 18C, and 18K to rotate the intermediate transfer belt 106*a* in a direction of the arrow V. The photoconductive drums 103Y, 103M, 103C, and 103K are rotated in a direction of the arrow S to be electrified by the electrifying units 104Y, 104M, 104C, and 104K. The laser optical system unit 105 forms electrostatic latent images based on the image of the original document on the photoconductive drums 103Y, 103M, 103C, and 103K. The developing units 11Y, 11M, 11C, and 11K form toner images on the photoconductive drums 103Y, 103M, 103C, and 103K.

The toner images formed on the photoconductive drums 103Y, 103M, 103C, and 103K are sequentially superposed on the intermediate transfer belt 106*a* by the primary transfer rollers 107Y, 107M, 107C, and 107K. A color toner image is formed on the intermediate transfer belt 106*a* by superposing the toner images. The color toner image formed on the intermediate transfer belt 106*a* is collectively secondary-transferred onto the sheet P by the secondary transfer roller 108 at the secondary transfer position. The sheet P is conveyed from the sheet feeding unit 121 at the timing when the color toner image on the intermediate transfer belt 106*a* reaches the secondary transfer position. The fixer 109 fixes the color toner image onto the sheet P.

A belt cleaner 112 cleans residual toner that remains after the toner image is secondary-transferred onto the sheet P. In addition, the photoconductor cleaners 111Y, 111M, 111C, and 111K remove the residual toner of the photoconductive drums 103Y, 103M, 103C, and 103K. The electricity removers 113Y, 113M, 113C, and 113K remove residual electric charges of the photoconductive drums 103Y, 103M, 103C, and 103K.

Figure 2:
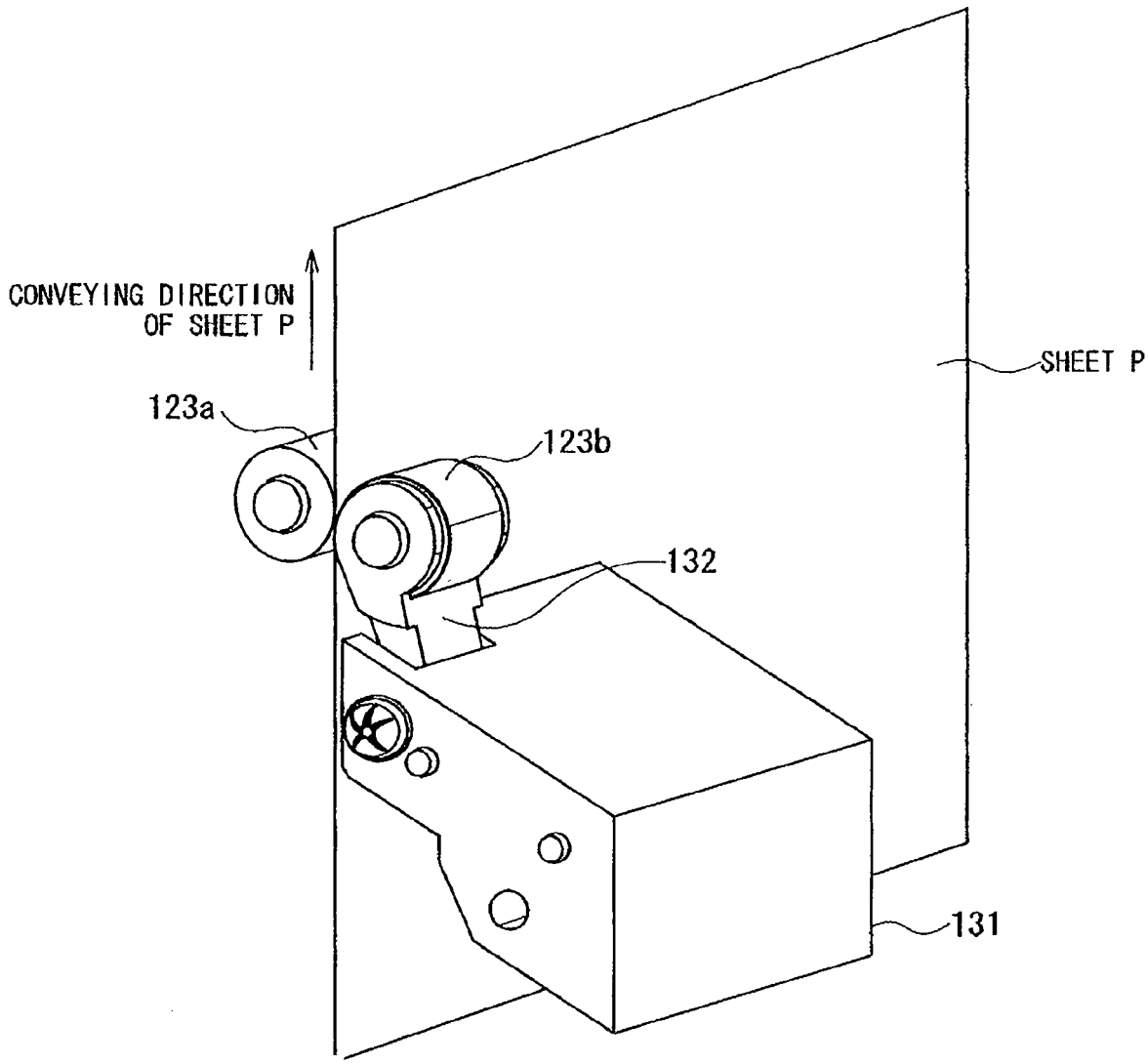
FIG. 2 is a diagram illustrating an operation mechanism of a media sensor.

A media sensor 131 for measuring a thickness of the sheet P is provided in the vicinity of the registration roller 123. The media sensor 131 is fixed to the movable roller 123*b* by an arm 132 as shown in FIG. 2. The sheet P passes through the gap between the stationary roller 123*a* and movable roller 123*b*. When the sheet P passes the gap between the stationary roller 123*a* and movable roller 123*b*, displacement of the arm 132 occurs, and the displacement is transferred to the displacement sensor provided in a bracket of the media sensor 131. The media sensor 131 converts an amount of the displacement of the displacement sensor into an electric signal, and measures a thickness of the sheet P on the basis of the converted electric signal.

Figure 3:
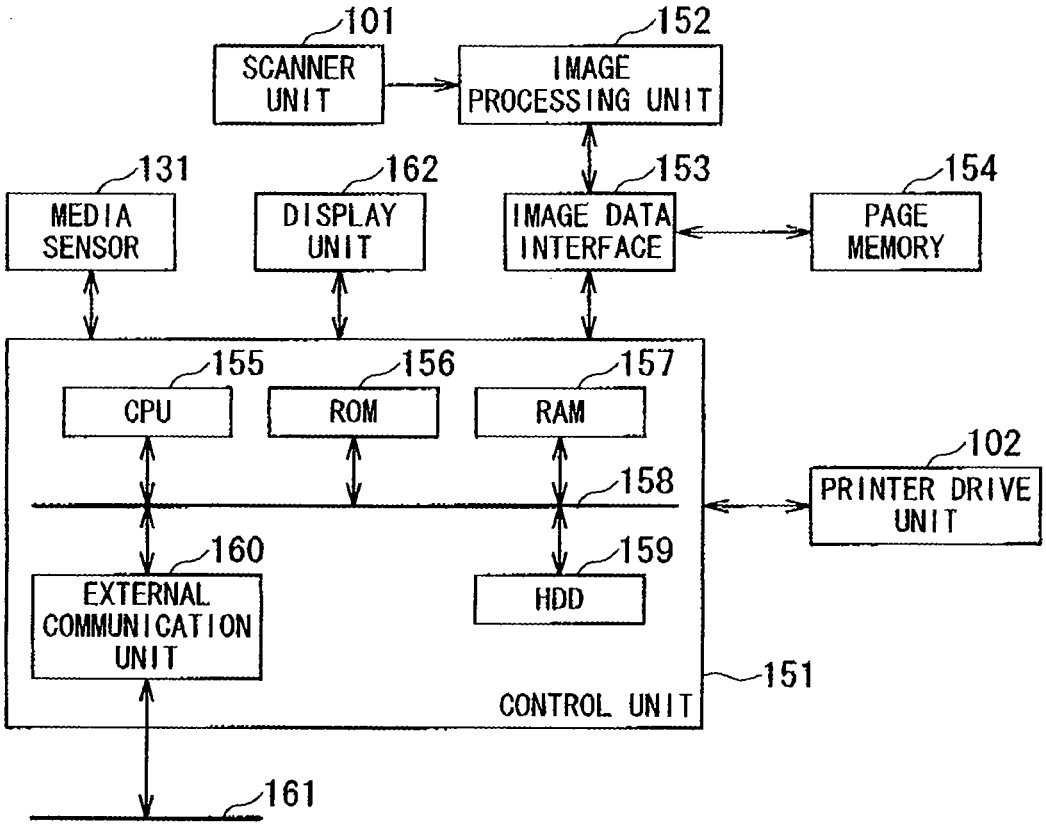
FIG. 3 is a block diagram illustrating a configuration of a control system of an image forming apparatus according to the embodiment.

FIG. 3 shows a configuration of control system of the image forming apparatus 1 according to the embodiment. In addition, if elements in the drawing correspond to the elements in FIG. 1, those elements are referenced by the same reference numerals and signs. As shown in FIG. 3, the image forming apparatus 1 includes the scanner unit 101, the printer drive unit 102, the media sensor 131, a control unit 151, an image processing unit 152, an image data interface 153, and a page memory 154. The control unit 151 includes a CPU (Central Processing Unit) 155, a ROM (Read Only Memory) 156, a RAM (Random Access Memory) 157, a bus 158, a HDD (Hard Disk Drive) 159, and an external communication unit 160. The CPU 155 executes various processes based on a program stored in the ROM 156 or various application programs loaded on the RAM 157 from the HDD 159. The CPU 155 also generates various control signals and supplies the signals to each part to control the image forming apparatus 1 as a whole. In the RAM 157, various data required in order for the CPU 155 to execute various processes are arbitrarily stored. The CPU 155, the ROM 156, the RAM 157, and the HDD 159 are connected to each other via the bus 158. In addition, an external communication unit 160 is connected to the bus 158. The external communication unit 160 has a modem, a terminal adapter, and a network interface. The external communication unit 160 communicates through a network 161.

The control unit 151 is connected to the printer drive unit 102, the media sensor 131, the image data interface 153, and a display unit 162. The display unit 162 includes a LCD (Liquid Crystal Display) The image processing unit 152 is connected to the page memory 154. The scanner unit 101 is connected to the image processing unit 152. Hereinafter, a flow of image data at the time of image formation will be described. When the original document is placed on original-document platen glass, image data of the original document is read by the scanner unit 101, and the read image data is supplied to the image processing unit 152. The image processing unit 152 acquires the image data of the original document supplied from the scanner unit 101, and performs a shading correction, various filterings, a toning, and a gamma correction on the acquired image data. The processed image data is stored in the page memory 154 through the image data interface 153, if needed. The printer drive unit 102 performs a drive in accordance with a control of the control unit 151.

Generally, when a pressure is applied, an object having a density lower than the other objects under the same composition tends to be more compressed. Specifically, the object having a lower density is more compressed than the other objects having a higher density, and thus a thickness of the object decreases. In the embodiment, considering the principle mentioned above, a thickness of the sheet P is measured before a pressure is applied to the sheet P, and a thickness of the sheet P is measured again after a pressure is applied to the sheet P by a pressing unit. Then, an estimated density of the sheet P is calculated on the basis of variation of the thickness of the sheet P before and after pressurization, and an amount of heat per unit area required to fix toner on the sheet P is calculated on the basis of the estimated density.

Figure 4:
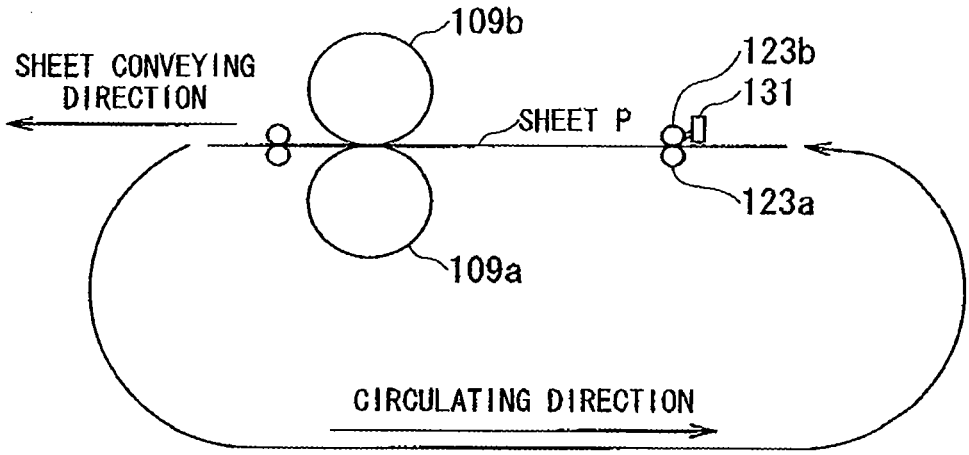
FIG. 4 is an explanatory diagram explaining a method of measuring a thickness of the sheet before and after pressurization by using one media sensor.

More specifically, a mechanism dedicated for pressurization may be provided as a pressing unit configured to press the sheet P. The mechanism dedicated for pressurization includes two rollers opposed to each other. Furthermore, the fixer 109 may be used as the pressing unit. In the embodiment, the fixer 109 is regarded as the pressing unit. As shown in FIG. 4, a thickness of the sheet P is measured by the media sensor 131 before the sheet P is pressed by the fixer 109, and then the sheet P is pressed by the fixer 109 (a pressing roller 109*a* and a heating roller 109*b*). The sheet P pressed by the fixer 109 is circulated through the reverse conveying mechanism 27, and passes through the media sensor 131 again. After the sheet P is pressed by the fixer 109, a thickness of the sheet P is measured by the media sensor 131.

Here, a density estimated on the basis of variation of the thickness of the sheet P before and after pressurization is defined as "estimated sheet density". The estimated sheet density is considered when an amount of heat per unit area required to fix toner on the sheet P is calculated on the basis of a thickness of the sheet P. In this manner, it is possible to calculate an amount of heat in which the estimated sheet density is reflected. Here, d1 is defined as a thickness of the sheet P before pressurization, d2 is defined as a thickness of the sheet P after pressurization, and σ is defined as a correction coefficient for correcting the thickness of the sheet P on the basis of a thickness variation of the sheet P. In addition, δd is defined as a thickness variation of the sheet P having a normal density before and after pressurization when a predetermined pressure is applied, and d is defined as a final thickness of the sheet P used for calculation of an amount of heat per unit area required to fix toner on the sheet P. In this case, relation of them is established as Numerical Expression 1.

$$d=d1-d1*\sigma\{(d1-\delta d)-d2\} \qquad \text{Numerical Expression 1}$$

Accordingly, if (d1−δd) is larger than d2, it can be assumed that a thickness variation of the sheet P before and after pressurization by the fixer 109 is larger than a thickness variation δd of the sheet P having the normal density, and the density of the sheet P is smaller than the normal density. In this case, the final thickness d of the sheet P used for calculation of an amount of heat is corrected to become smaller than a thickness d1 of the sheet P before pressurization as a reference. In contrast, if (d1−δd) is smaller than d2, it can be assumed that a thickness variation of the sheet P before and after pressurization performed by the fixer 109 is smaller than a thickness variation δd of the sheet P having the normal density, and a density of the sheet P is larger than the normal density. In this case, the final thickness d of the sheet P used for calculation of an amount of heat is corrected to become larger than a thickness d1 of the sheet P before pressurization as a reference. Hereinafter, a process for calculating an amount of heat for the fixing operation based on the method mentioned above will be described.

Figure 5:
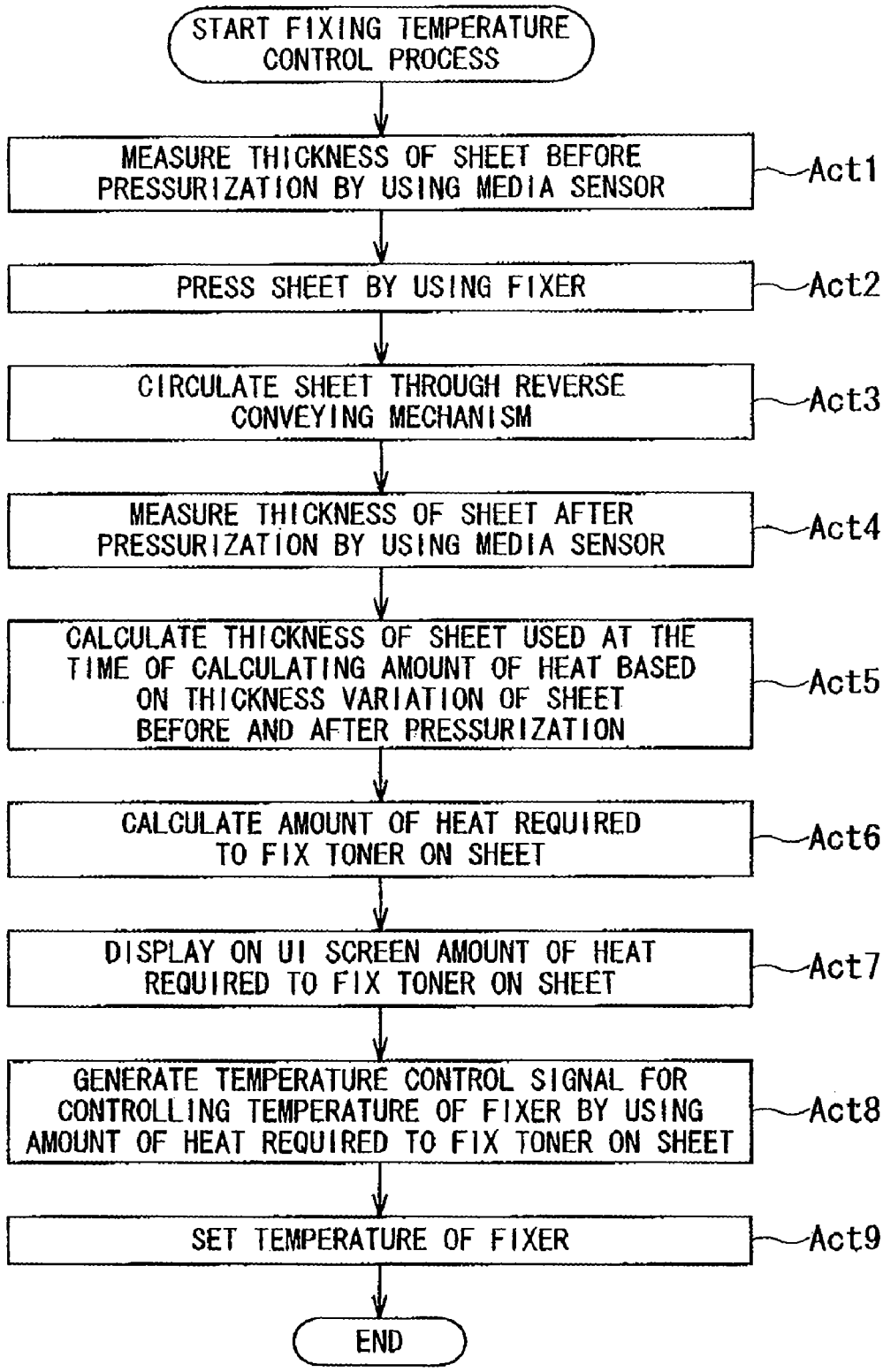
FIG. 5 is a flowchart explaining a fixing temperature control process in the image forming apparatus shown in FIG. 3.

By referring to the flowchart of FIG. 5, a fixing temperature control process in the image forming apparatus 1 shown in FIG. 3 will be described. Furthermore, the fixing temperature control process is started when opening or closing of a sheet tray is detected, or when the image forming apparatus 1 is initially started without information on opening or closing of the sheet tray.

In Act 1, when the sheet P passes between the stationary roller 123*a* and movable roller 123*b*, the media sensor 131 measures a thickness of the sheet P before the fixer 109 presses the sheet P, and supplies a measurement result d1 to the control unit 151. The control unit 151 acquires the measurement result d1 from the media sensor 131, and temporarily stores the acquired measurement result d1 in the RAM 157. In Act 2, the control unit 151 controls the fixer 109 of the printer drive unit 102 to press the sheet P at a required pressure by using the pressing roller 109*a* and the heating roller 109*b* of the fixer 109. In Act 3, the control unit 151 controls the reverse conveying mechanism 27 of the printer drive unit 102 to circulate the sheet P, which is pressed by using the fixer 109, through the reverse conveying mechanism 27, thereby guiding the sheet P to the position of the media sensor 131.

In Act 4, the media sensor 131 measures a thickness of the sheet P after the fixer 109 presses the sheet P when the sheet P passes between the stationary roller 123*a* and the movable roller 123*b* to supply a measurement result d2 to the control unit 151. The control unit 151 acquires the measurement result d2 from the media sensor 131, and temporarily stores the acquired measurement result d2 in the RAM 157. In Act 5, by substituting the two measurement results d1 and d2 acquired from the media sensor 131 for Numerical Expression 1 mentioned above, the control unit 151 calculates a final thickness d of the sheet P used for calculation of an amount of heat, on the basis of the thickness variation of the sheet P before and after pressurization. As already mentioned above, when a density of the sheet P is smaller than the normal density, the final thickness d of the sheet P used for calculation of an amount of heat is corrected to become smaller than a thickness d1 of the sheet P before pressurization as a reference. In contrast, when (d1−δd) is smaller than d2, that is, when a density of the sheet P is larger than the normal density, the final thickness d of the sheet P used for calculation of an amount of heat is corrected to become larger than a thickness d1 of the sheet P before pressurization as a reference.

In Act 6, the control unit 151 calculates a basis weight ($g/m^2$) of the sheet P, by using the final thickness d of the sheet P used for calculation of an amount of heat. Then, the control unit calculates an amount of heat ($J/mm^2$) required to fix toner on the sheet P, on the basis of the basis weight of the sheet P. In Act 7, the control unit 151 controls the display unit 162 to display on a UI screen the amount of heat required to fix toner on the sheet P. In Act 8, the control unit 151 generates a temperature control signal for controlling a temperature of the fixer 109 on the basis of the amount of heat required to fix toner on the sheet P, and supplies the temperature control signal to the fixer 109 of the printer drive unit 102. In Act 9, in the fixer 109, a temperature of the fixer 109 used for fixation of toner on the sheet P is set as a temperature corresponding to the calculated amount of heat required to fix toner on the sheet P, on the basis of the temperature control signal from control unit 151.

Incidentally, a thickness of the sheet P may be measured by using two media sensors 131 instead of one media sensor 131. When a thickness of the sheet P is measured by using only one media sensor 131, there is an advantage that the measurement is free from errors caused by variance in performances of media sensors 131. On the other hand, when a thickness of the sheet P is measured by using two media sensors 131, there is an advantage that the invention can be also applied to the image forming apparatus 1 not provided with the reverse conveying mechanism 27. Hereinafter, a fixing temperature control process in the case of using two media sensors 131 will be described.

Figure 6:
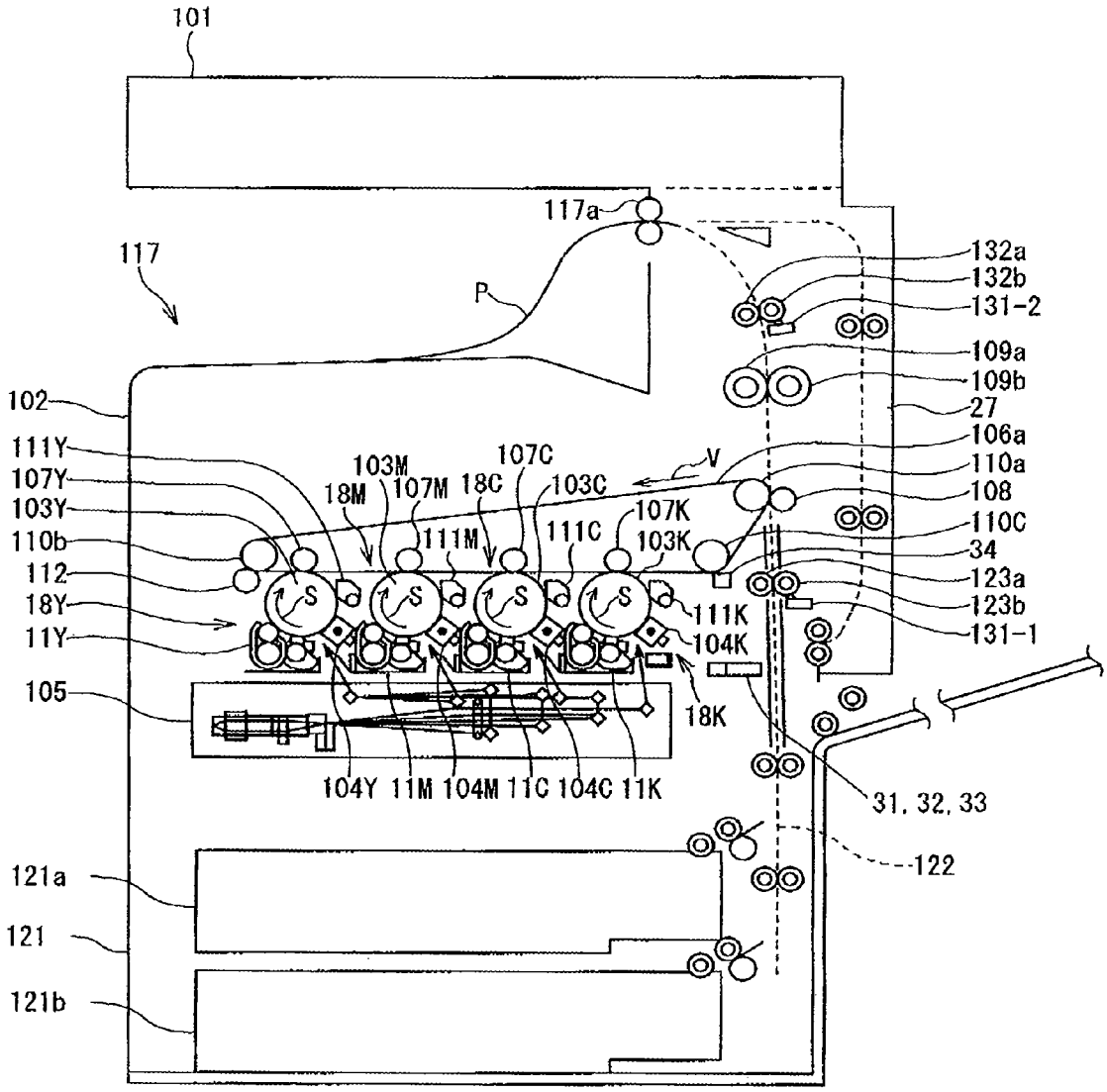
FIG. 6 is a diagram illustrating a configuration of another image forming apparatus according to the embodiment.

FIG. 6 shows a configuration of another image forming apparatus 1 according to the embodiment. As shown in FIG. 6, a first media sensor 131-1 is provided in the vicinity of the registration roller 123. Furthermore, a second media sensor 131-2 is provided in the vicinity of the registration roller 132 disposed on the downstream side of the fixer 109 in a sheet conveying direction. The second media sensor 131-2 is fixed on the movable roller 132*b* by the arm. The second media sensor 131-2 converts a displacement amount of the displacement sensor into an electric signal, and measures a thickness of the sheet P after pressurization performed by the fixer 109 on the basis of the converted electric signal.

Figure 7:
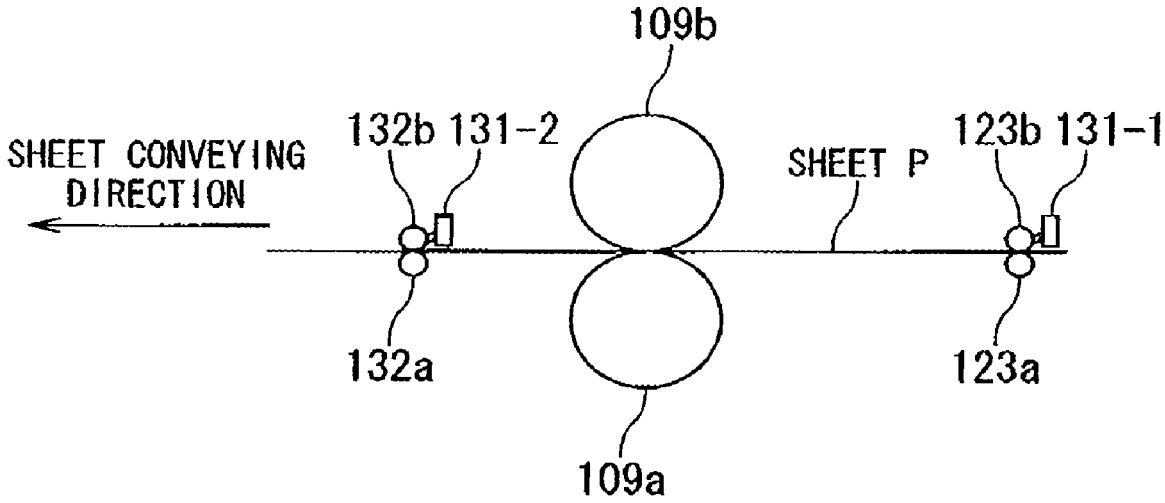
FIG. 7 is an explanatory diagram explaining a method of measuring a thickness of the sheet before and after pressurization by using two media sensors.

When a thickness of the sheet P before and after pressurization is measured by using the first media sensor 131-1 and the second media sensor 131-2, the measurement procedure is as follows. As shown in FIG. 7, a thickness of the sheet P is measured by the first media sensor 131-1 before the sheet P is pressed by the fixer 109. Subsequently, the sheet P is pressed by the fixer 109 (the pressing roller 109*a* and the heating roller 109*b*). After being pressed by the fixer 109, the sheet P passes through the second media sensor 131-2 disposed on the downstream side of the fixer 109 in the sheet conveying direction. The second media sensor 131-2 measures a thickness of the sheet P after the sheet P is pressed by the fixer 109.

Figure 8:
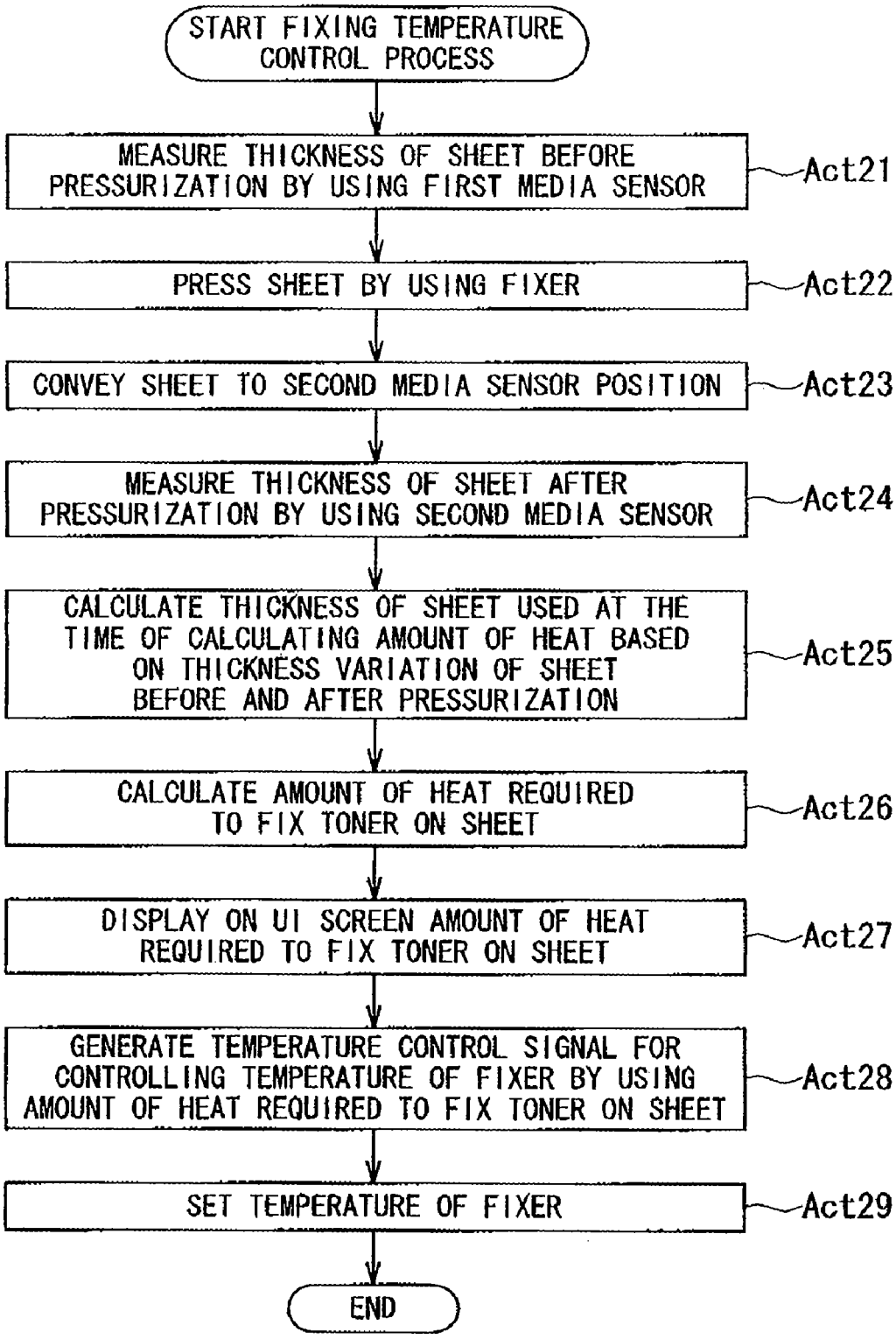
FIG. 8 is a flowchart explaining another fixing temperature control process in the image forming apparatus shown in FIG. 3.

By referring to a flowchart of FIG. 8, another fixing temperature control process in the image forming apparatus 1 shown in FIG. 3 will be described. Incidentally, the process in Acts 25 to 29 shown in FIG. 8 is similar to the process in Acts 5 to 9 shown in FIG. 5, and thus the repeated description thereof will be omitted.

In Act 21, when the sheet P passes between the stationary roller 123*a* and movable roller 123*b*, the first media sensor 131-1 measures a thickness of the sheet P before the fixer 109 presses the sheet P, and supplies a measurement result d1 to the control unit 151. The control unit 151 acquires the measurement result d1 from the first media sensor 131-1, and temporarily stores the acquired measurement result d1 in the RAM 157. In Act 22, the control unit 151 controls the fixer 109 of the printer drive unit 102 to press the sheet P at a required pressure by using the pressing roller 109*a* and the heating roller 109 of the fixer 109. In Act 23, the control unit 151 controls the printer drive unit 102 to convey the sheet P pressed by using the fixer 109 to the position of the second media sensor 131-2.

In Act 24, the second media sensor 131-2 measures a thickness of the sheet P after the fixer 109 presses the sheet P when the sheet P passes between the stationary roller 123*a* and the movable roller 123*b* to supply a measurement result d2 to the control unit 151. The control unit 151 acquires the measurement result d2 from the second media sensor 131-2, and temporarily stores the acquired measurement result d2 in the RAM 157.

Figure 9:
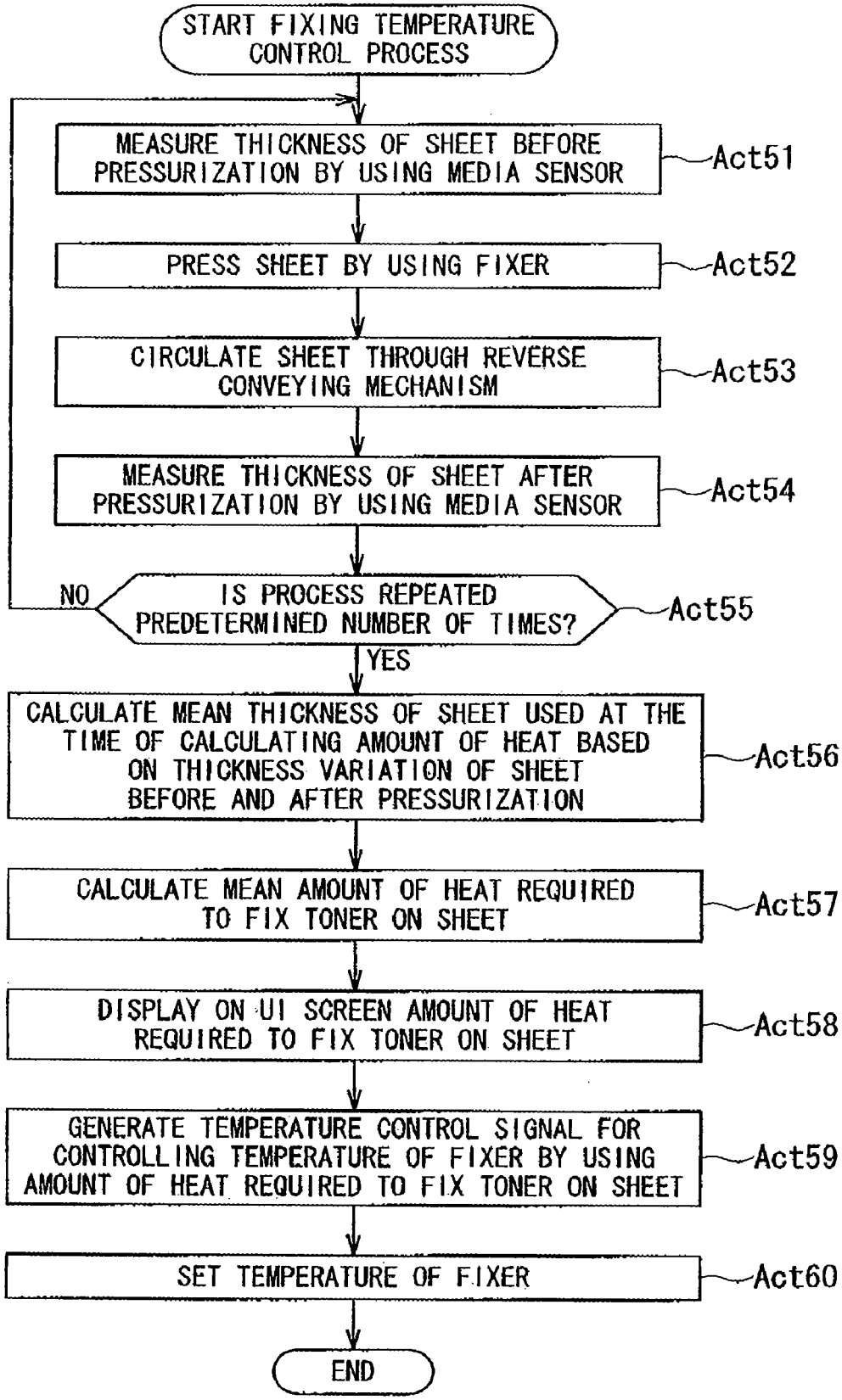
FIG. 9 is a flowchart explaining another fixing temperature control process in the image forming apparatus shown in FIG. 3.

Incidentally, in order to improve precision in measurement of a thickness of the sheet P and to improve precision in an amount of heat required to fix toner on the sheet P, measurement using the media sensor 131 may be performed a plurality of times. The fixing temperature control process in the case mentioned above is shown in the flowchart of FIG. 9. In addition, the process in Acts 51 to 54 and 58 to 60 shown in FIG. 9 is similar to the process in Acts 1 to 4 and 7 to 9 shown in FIG. 5, and thus the repeated description thereof will be omitted.

In Act 55, the control unit 151 determines whether the media sensor 131 repeatedly measures a thickness of the sheet P before and after pressurization a predetermined number of times (for example, three times and the like) set previously. If the control unit 151 determines that the media sensor 131 does not repeatedly measure a thickness of the sheet P before and after pressurization a predetermined number of times set previously in Act 55, the process returns to Act 51. Then, the process after Act 51 is repeated until the measurement of a thickness of the sheet P is repeated a predetermined number of times set previously.

In contrast, if the control unit 151 determines that the media sensor 131 repeatedly measures a thickness of the sheet P before and after pressurization a predetermined number of times set previously in Act 55, the process proceeds to Act 56. In Act 56, by substituting two measurement results d1 and d2 from the media sensor 131 for Numerical Expression 1 mentioned above for each measurement, the control unit 151 calculates the final thickness d of the sheet P used for calculation of an amount of heat on the basis of variation of the thickness of the sheet P before and after pressurization, and obtains the mean value of the plural calculation results. In Act 57, the control unit 151 calculates a mean value of basis weights ($g/m^2$) of the sheet P, by using the mean value of the final thickness d of the sheet P used for calculation of an amount of heat. Then, the control unit calculates a mean value of amounts of heat ($J/mm^2$) required to fix toner on the sheet P, on the basis of the mean value of the basis weights of the sheet P.

In this manner, it is possible to improve precision of the amount of heat required to fix toner on the sheet P.

In the embodiment, the toner is fixed on the sheet P, the sheet P is pressed, a thickness of the sheet P before pressurization is measured, and a thickness of the sheet P after pressurization is measured. Then, an amount of heat required when the fixer 109 fixes toner on the sheet is calculated on the basis of the measurement result. On the basis of the calculated amount of heat, it is possible to control the temperature of the fixer 109. In this manner, considering the density of the sheet P, it is possible to appropriately calculate an amount of heat per unit area required to fix toner on the sheet P. Accordingly, it is possible to appropriately control the temperature of the fixer 109. It is also possible to prevent defect in image quality, and to control the amount of heat not to be unnecessarily applied. Therefore, it is possible to achieve low power consumption.

Incidentally, the processes described in the embodiments of the invention may be performed by hardware, instead of software.

Moreover, in the embodiments of the invention, the acts in the flowchart are described as an example of time-series process performed in the written order. However, not only the time-series process but also parallel or individual process may be performed. In addition, the elements explicitly described in the embodiment may be combined as the need arises.

What is claimed is:

1. An image forming apparatus comprising:

a fixing unit configured to fix toner on a sheet;

a pressing unit configured to press the sheet;

a measuring unit configured to measure a thickness of the sheet before the sheet is pressed by the pressing unit, and measuring a thickness of the sheet after the sheet is pressed by the pressing unit;

a calculating unit configured to calculate an amount of heat used if the fixing unit fixes the toner on the sheet, on the basis of a measurement result obtained by the measuring unit; and a control unit configured to control the fixing unit on the basis of the amount of heat calculated by the calculating unit.

2. The apparatus according to claim 1, wherein the fixing unit includes a pressing roller and a heating roller opposed to each other, and the control unit controls the fixing unit by setting a temperature of the heating roller on the basis of the amount of heat calculated by the calculating unit.

3. The apparatus according to claim 1, wherein the measuring unit is a single sensor.

4. The apparatus according to claim 3, wherein the measuring unit measures a thickness of the sheet before the sheet is pressed by the pressing unit, the pressing unit presses the sheet, the sheet pressed by the pressing unit is conveyed to the measuring unit through a circulating and conveying mechanism, and the measuring unit measures a thickness of the sheet after the sheet is pressed by the pressing unit.

5. The apparatus according to claim 3, wherein the measuring unit is provided on a downstream side of the pressing unit in a sheet conveying direction.

6. The apparatus according to claim 1, wherein the measuring unit includes a first sensor and a second sensor.

7. The apparatus according to claim 6, wherein the first sensor in the measuring unit measures a thickness of the sheet before the sheet is pressed by the pressing unit, the pressing unit presses the sheet, and the second sensor in the measuring unit measures a thickness of the sheet after the sheet is pressed by the pressing unit.

8. The apparatus according to claim 6, wherein the first sensor in the measuring unit is provided on a downstream side of the pressing unit in a sheet conveying direction, and the second sensor in the measuring unit is provided on an upstream side of the pressing unit in the sheet conveying direction.

9. The apparatus according to claim 1, wherein the measuring unit measures a thickness of the sheet a predetermined number of times set in advance before and after the sheet is pressed by the pressing unit, and the calculating unit calculates an amount of heat used if the fixing unit fixes the toner on the sheet, on the basis of a plurality of measurement results obtained by the measuring unit.

10. The apparatus according to claim 1, wherein the pressing unit includes two pressing rollers opposed to each other.

11. An image forming apparatus comprising:

a fixing unit configured to fix toner on a sheet, the fixing unit including a pressing roller and a heating roller opposed to each other;

a measuring unit configured to measure a thickness of the sheet before the sheet is pressed by the fixing unit, and measuring a thickness of the sheet after the sheet is pressed by the fixing unit;

a calculating unit configured to calculate an amount of heat used if the fixing unit fixes the toner on the sheet, on the basis of a measurement result obtained by the measuring unit; and a control unit configured to control the fixing unit on the basis of the amount of heat calculated by the calculating unit.

12. The apparatus according to claim 11, wherein the control unit controls the fixing unit by setting a temperature of the heating roller on the basis of the amount of heat calculated by the calculating unit.

13. The apparatus according to claim 11, wherein the measuring unit is a single sensor.

14. The apparatus according to claim 13, wherein the measuring unit measures a thickness of the sheet before the sheet is pressed by the fixing unit, the fixing unit presses the sheet, the sheet pressed by the fixing unit is conveyed to the measuring unit through a circulating mechanism, and the measuring unit measures a thickness of the sheet after the sheet is pressed by the fixing unit.

15. The apparatus according to claim 13, wherein the measuring unit is provided on a downstream side of the fixing unit in a sheet conveying direction.

16. The apparatus according to claim 11, wherein the measuring unit includes a first sensor and a second sensor.

17. The apparatus according to claim 16, wherein the first sensor in the measuring unit measures a thickness of the sheet before the sheet is pressed by the fixing unit, the fixing unit presses the sheet, and the second sensor in the measuring unit measures a thickness of the sheet after the sheet is pressed by the fixing unit.

18. The apparatus according to claim 16, wherein the first sensor in the measuring unit is provided on a downstream side of the fixing unit in a sheet conveying direction, and the second sensor in the measuring unit is provided on an upstream side of the fixing unit in the sheet conveying direction.

19. The apparatus according to claim 11, wherein the measuring unit measures a thickness of the sheet a predetermined number of times set in advance before and after the sheet is pressed by the fixing unit, and the calculating unit calculates an amount of heat used if the fixing unit fixes the toner on the sheet, on the basis of a plurality of measurement results obtained by the measuring unit.

20. An image forming method comprising the steps of:

preparing an image forming apparatus having a fixer including a pressing roller and a heating roller;

fixing toner on a sheet;

pressing the sheet;

measuring a thickness of the sheet before pressurization, measuring a thickness of the sheet after pressurization, and calculating an amount of heat required to fix the toner on the sheet, on the basis of a measurement result; and controlling the fixer on the basis of the calculated amount of heat.

* * * * *